US006755065B2

(12) United States Patent
Ostertag

(10) Patent No.: US 6,755,065 B2
(45) Date of Patent: Jun. 29, 2004

(54) METHOD OF AND TOOL FOR ROLLING A WORKPIECE, AND ARRANGEMENT OF A ROLLING TOOL AND A WORKPIECE

(75) Inventor: Alfred Ostertag, Celle (DE)

(73) Assignee: Ecoroll AG Werkzeugtechnik, Celle (DE)

( * ) Notice: Subject to any disclaimer, the term of this patent is extended or adjusted under 35 U.S.C. 154(b) by 0 days.

(21) Appl. No.: 10/179,363

(22) Filed: Jun. 25, 2002

(65) Prior Publication Data

US 2003/0010080 A1 Jan. 16, 2003

(30) Foreign Application Priority Data

Jul. 12, 2001 (DE) ..... 101 33 314

(51) Int. Cl.[7] ..... B21B 29/00; B21C 37/30
(52) U.S. Cl. ..... 72/75; 29/90.01
(58) Field of Search ..... 72/75, 243.4; 29/90.01

(56) References Cited

U.S. PATENT DOCUMENTS

| | | | | | |
|---|---|---|---|---|---|
| 2,575,938 | A | | 11/1951 | Renneke | |
| 3,201,827 | A | * | 8/1965 | Reynolds et al. | 26/83 |
| 3,911,707 | A | * | 10/1975 | Minakov et al. | 72/75 |
| 3,934,443 | A | * | 1/1976 | Keen | 72/75 |
| 4,947,668 | A | * | 8/1990 | Ostertag | 72/75 |
| 4,974,434 | A | * | 12/1990 | Reccius et al. | 72/53 |
| 5,308,307 | A | * | 5/1994 | Morel et al. | 492/1 |
| 5,596,896 | A | * | 1/1997 | Snell | 72/75 |
| 6,446,477 | B2 | * | 9/2002 | Yasuda et al. | 72/243.4 |

FOREIGN PATENT DOCUMENTS

| | | |
|---|---|---|
| DE | 25 21 014 | 11/1976 |
| DE | 4015205 C | 8/1991 |
| DE | 195 16 834 A1 | 11/1996 |
| DE | 195 34 631 A1 | 3/1997 |
| DE | 19534631 A | 3/1997 |
| EP | 0353376 A | 2/1990 |
| EP | 0 353 376 A1 | 2/1990 |
| FR | 864956 A | 5/1941 |
| JP | 2000317828 A | 11/2000 |
| WO | WO 00/20170 | 4/2000 |

* cited by examiner

*Primary Examiner*—Ed Tolan
(74) *Attorney, Agent, or Firm*—Henry M. Feiereisen; Ursula B. Day

(57) ABSTRACT

For rolling a workpiece with a rolling tool with several rolling elements arranged in hydrostatic bearings, during rolling, only some of the rolling elements engage the workpiece, while the rolling elements not engaging the workpiece essentially seal off the hydrostatic bearing. In such a rolling tool, the rolling elements are arranged so as to be distributed over an area, and each of the hydrostatic bearings includes a circumferential seal in the region of the rolling elements.

19 Claims, 4 Drawing Sheets

METHOD OF AND TOOL FOR ROLLING A WORKPIECE, AND ARRANGEMENT OF A ROLLING TOOL AND A WORKPIECE

CROSS-REFERENCES TO RELATED APPLICATIONS

This application claims the priority of German Patent Application Ser. No. 101 33 314.5, filed Jul. 12, 2001, pursuant to 35 U.S.C. 119(a)–(d), the subject matter of which is incorporated herein by reference.

BACKGROUND OF THE INVENTION

The present invention relates to a method for rolling a workpiece with a rolling tool with several rolling elements arranged in hydrostatic bearings. The present invention further relates to a rolling tool with several rolling elements arranged in hydrostatic bearings, and an arrangement of such a rolling tool and a workpiece.

To ensure clarity, it is necessary to establish the definition of several important terms and expressions that will be used throughout this disclosure. The term "rolling tool with several rolling elements arranged in hydrostatic bearings" refers to any tool which is suitable for exerting pressure forces onto a workpiece by way of rolling elements. This includes, in particular, planishing and solid-rolling. These are technologically very effective methods for smoothing surfaces, in particular of metallic components, and for solidification of the skin in order to increase fatigue resistance.

For planishing and solid-rolling, i.a., hydrostatic rolling tools are used, as described in European Pat. No. EP 0 353 376 A1. Highly loaded workpiece contours arranged on the inside are usually not accessible to these tools. Other methods must be used for contours which are so small and complex that known tools, due to their design size, do not fit into the regions to be worked. Furthermore, the tools, which usually only comprise one ball or roller or several balls or rollers, require a three-dimensional movement sequence which completely matches the workpiece contour, said movement sequence having to be carried out by the machine control system. This requires an expensive control system which most of the time turns out to be impracticable.

The shot-peening process is thus often used for skin solidification of complex contours, as there is a lack of better methods. The shot-peening process is associated with the disadvantage of shallow penetration depth and thus reduced effectiveness compared to roll methods. Moreover, the confined spaces in the case of complex contours often result in the used peening material banking up instead of flowing away freely. This further reduces the effectiveness of the shot-peening process.

Complex contours can also be rolled with single-roll mechanical tools or hydrostatic tools. The rolling process then takes place at an action point between the roll and the tool surface. The area of the workpiece can be achieved by two-dimensional movement of the tool or the workpiece. This includes, for example, rotation of the tool and advance of the tool. In the case of complex areas such as for example free-form areas, a feed movement in the third axis is superimposed.

Occasionally, rolling tools with several hydrostatic roll elements arranged on a circumferential line of a tool are used. These tools are suitable for treating interior circular lines, and, if the tool or the workpiece carries out a feed movement, they are also suitable for treating interior cylinder surfaces. However, the use of these tools is limited to applications of this kind.

It would therefore be desirable and advantageous to provide an improved method for rolling a workpiece with a rolling tool with several rolling elements arranged in hydrostatic bearings, which obviates prior art shortcomings and allows simple and effective treatment of workpieces.

SUMMARY OF THE INVENTION

According to one aspect of the present invention, in a method for rolling a workpiece, a rolling tool has several rolling elements which are arranged in hydrostatic bearings, wherein during rolling, only some of the rolling elements engage the workpiece, while those rolling elements that are not in engagement with the workpiece essentially seal off the hydrostatic bearing.

Unlike conventional methods that use rolling tools with several rolling elements arranged in hydrostatic bearings, whereby all rolling elements are in constant engagement during the entire rolling process, the rolling method according to the present invention is based on the recognition that there are new possibilities for producing hydrostatic rolling tools if sealing is provided for the hydrostatic bearings which are not engaged. This sealing action is achieved in a simple way by those rolling elements which do not engage the workpiece in order to assume the sealing function of the associated hydrostatic bearings. As a result, the control operation is considerably facilitated because the lateral movement component of the rolling element can be exploited for sealing the hydrostatic bearing during interaction with the workpiece and during the disengagement of the rolling element.

It has been shown that the hydrostatic pressure acting on the rolling elements is normally sufficient to press the rolling element against a circumferential area which acts as a valve seat.

According to another feature of the present invention, the rolling tool may be moved in a linear or rotational manner. Thus, any interior or exterior surfaces of the workpiece can be manipulated by the rolling tool. The arrangement of the hydrostatic bearings on a tool body can be suited to the profile of the workpiece to be worked on. However, it is also possible to design rolling tools for universal use which tools can be guided so as to move in a translational and/or rotary way along the workpiece surfaces.

An advantageous variant of the process according to the invention provides for a repeated treatment of a same position of the workpiece, when the rolling tool is moved linearly in one direction. It is also possible to roll closely adjacent areas of the workpiece, using rolling elements which are successively guided over the workpiece. When using a plurality of rolling elements, it is also possible to repeatedly roll the same positions of the workpiece, using different rolling elements of the same tool. In this way, the rolling quality can be enhanced through suitable selection of the tool size or number of the rolling elements.

According to another aspect of the present invention, a rolling tool includes several rolling elements arranged in hydrostatic bearings in which the rolling elements are arranged so as to be distributed over an area.

Unlike conventional rolling tools having rolling elements arranged along a straight circumferential line, the rolling tool according to the invention provides for the rolling elements to be arranged so as to be distributed over an area of the rolling tool. In this way, the rolling elements are able to roll in a single rolling operation, not only a line, but also an area of the workpiece.

According to another feature of the present invention, the area may be curved at least in one direction. The area can thus be suited to the contour of the workpiece or allows between the tool and the workpiece an optimal engagement that is easy to control.

The area on which the rolling elements are arranged in spaced-apart relationship may also include concave and convex kinks, wherein rolling elements are suitably arranged in the region of the kinks. In this way, the rolling tool can be suited to specific workpieces for optimal rolling operation.

The rolling elements can be arranged on the rolling tool along parallel lines or along parallel circumferential lines. Currently preferred is a configuration in which those rolling elements disposed successively in rolling direction are arranged in offset relationship. As a consequence of the offset arrangement of the rolling elements, no single position of the workpiece is rolled repeatedly, but instead, closely adjacent positions of the workpiece are rolled so as to roll an area as evenly as possible.

When the number of rolling elements arranged in hydrostatic bearings on a rolling tool exceeds five bearings which are supplied together with hydraulic fluid, then the quantity of fluid required during the rolling process increases to such an extent that effective rolling operation is no longer possible. For this reason, according to the invention, it is proposed that, in the case of rolling tools having several rolling elements arranged in hydrostatic bearings, each of the hydrostatic bearings includes a circumferential seal in the region of the rolling elements.

In conventional hydrostatic bearings, it was possible to stop the supply of hydraulic fluid for all bearings together. However, individual control of the supply of hydraulic fluid to individual bearings was not possible. In accordance with the present invention, a circumferential seal may be provided in the region of the rolling elements. The arrangement of a seal in this position allows opening or closing of the seal through lateral movement of the rolling elements. Thus a hydrostatic bearing can be opened or sealed by interaction between rolling element and workpiece, without the need for an additional control system or regulating system.

According to another feature of the present invention, the hydrostatic bearings may include a sealing gap which is so dimensioned as to act as hydraulic throttle. It is the basic function of the sealing gap to enable or stop the through-flow of hydraulic fluid. The design as a hydraulic throttle has the advantage that even when the sealing gap is open, only a quantity of hydraulic fluid, defined by throttle action, flows through the sealing gap and reaches the region between the tool or the rolling element and the workpiece. In this way too, the quantity of hydraulic fluid issuing through the multitude of hydrostatic bearings is reduced.

According to still another aspect of the present invention, an arrangement includes a rolling tool with several rolling elements arranged in hydrostatic bearings, and a workpiece, whereby some of the rolling elements protrude beyond the hydrostatic bearing commensurate with a distance between the hydrostatic bearing and the workpiece, while some other rolling elements protrude beyond the hydrostatic bearing by more than the distance.

In this arrangement, the position of the rolling element thus changes in dependence on whether or not the rolling element engages the workpiece. Thus, the position of the rolling element can be exploited for sealing and controlling a throttle. When there is particular firm bearing pressure between the rolling element and the workpiece, the throttle between the hydrostatic bearing and the rolling element is opened up wide, with a considerable quantity of hydraulic fluid issuing as a consequence. However, if the bearing pressure between the rolling element and the workpiece is low, the throttle is opened only slightly so that only a relatively small quantity of hydraulic fluid leaves the hydrostatic bearing. Finally, when the rolling element no longer engages the workpiece, the throttle turns into a seal, preferably completely sealing off the issue of hydraulic fluid.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
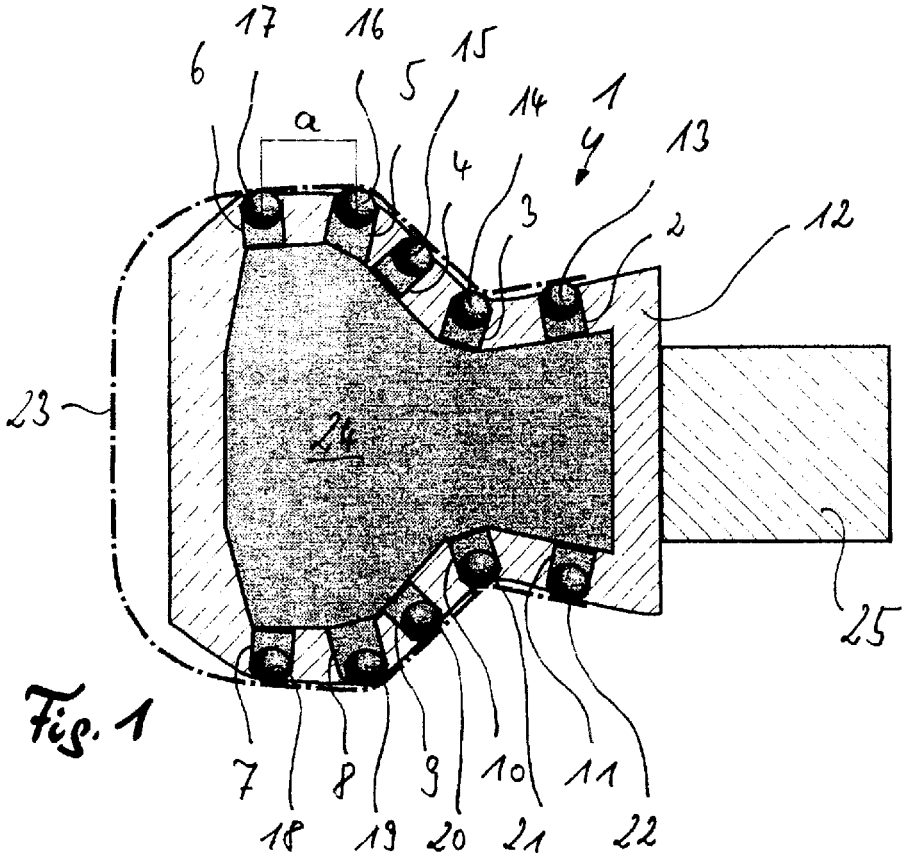
FIG. 1 is a sectional view of a tool according to the invention, taken along the line shown I—I in FIG. 2.

Each of the rolling tools 1, 50, and 60, shown in the figures, includes a multitude of hydrostatic bearings 2 to 11 which are arranged in a tool body 12. In each hydrostatic bearing, a ball 13 to 22 is arranged as a rolling element. The enveloping line of the balls 13 to 22 approximates the schematically shown workpiece contour 23. The workpiece contour 23 shows that only those areas of the tool 1 have rolling elements 13 to 22, which areas require rolling operation of the contour 23 of the workpiece.

The hydrostatic bearings 2 to 11 are connected to a central fluid supply space 24 so that hydraulic fluid can be supplied equally to all hydrostatic bearings 2 to 11.

The rolling elements are arranged at a distance a from each other. This distance is essentially determined by the size of the rolling elements 13 to 22 and the required stability of the tool body 12.

Figure 4:
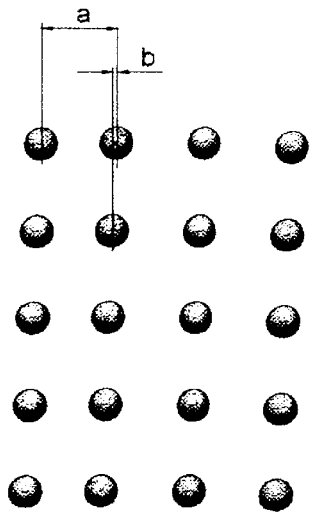
FIG. 4 is an enlarged detailed view of the area marked z in FIG. 2.

A multitude of similar arrangements is provided along the length L of tool 1. However, the rolling elements 13 to 22 are not arranged one behind the other, but instead, as shown in FIG. 4, offset from plane to plane by a lateral distance b.

Figure 2:
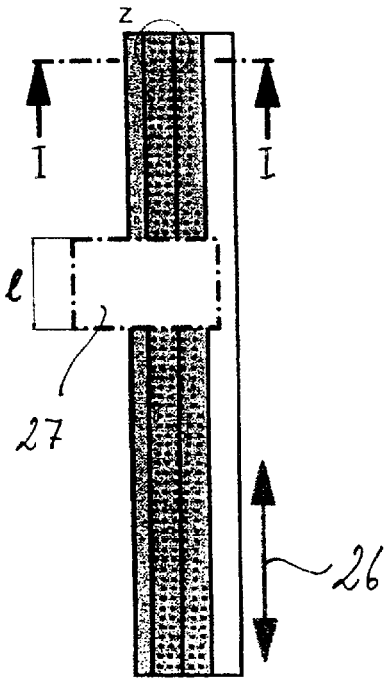
FIG. 2 is a top view of the tool according to the invention in combination with a schematically illustrated workpiece.

The tool body 12 comprises a clamping shank 25 which forms the interface to the treatment machine (not shown). In the tool 1 described, the treatment machine merely carries out a linear to-and-from movement as is indicated in FIG. 2 by arrow 26, so as to roll the workpiece 27 over its entire length 1. Each rolling element 13 to 22 leaves a track in parallel alignment to the direction of movement 26 of the tool 1. With progressive rolling operation, the longitudinal movement 26 of tool 1 thus generates a multitude of tracks spaced apart by the distance b. Provided there is an adequate number of ball planes, the entire surface of the workpiece 27 which is to be treated, is covered by tracks spaced apart at a distance b, and is thus completely treated. If the tool 1 is made in double length, dual rolling operation which is desirable for reasons of process safety, can take place in one working step.

FIG. 2 clearly shows that the rolling elements are arranged along lines extending transversely to the longitudinal axis of the tool 1. This results in an offset b which effects treatment of the workpiece 27 over an area. The same effect can also be achieved in that the rolling elements are arranged along lines which extend parallel to the longitudinal axis of the tool when the tool is moved somewhat transversely to the movement direction 26 shown in the drawing. By setting the tool 1 to a transverse position in relation to the movement direction 26, the distance b can be varied randomly, either to roll the workpiece along closely spaced lines, and/or to rework the workpiece several times in one passage.

Figure 3:
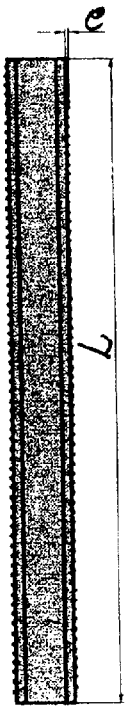
FIG. 3 is a side view of the tool shown in FIG. 2.

FIGS. 2 and 3 show that the tool length L is a multiple of the workpiece length 1. This means that a large number of rolling elements are not engaged, while only a small number of rolling elements are in engagement. Such an arrangement cannot be realized with a conventional tool, because the non-engaging rolling elements let pressure fluid issue freely. This results in such extensive loss of fluid in the tool regions outside the workpiece, that the common pressure supply for all rolling elements, which supply is arranged via chamber 24, would not be adequate.

Figure 5:
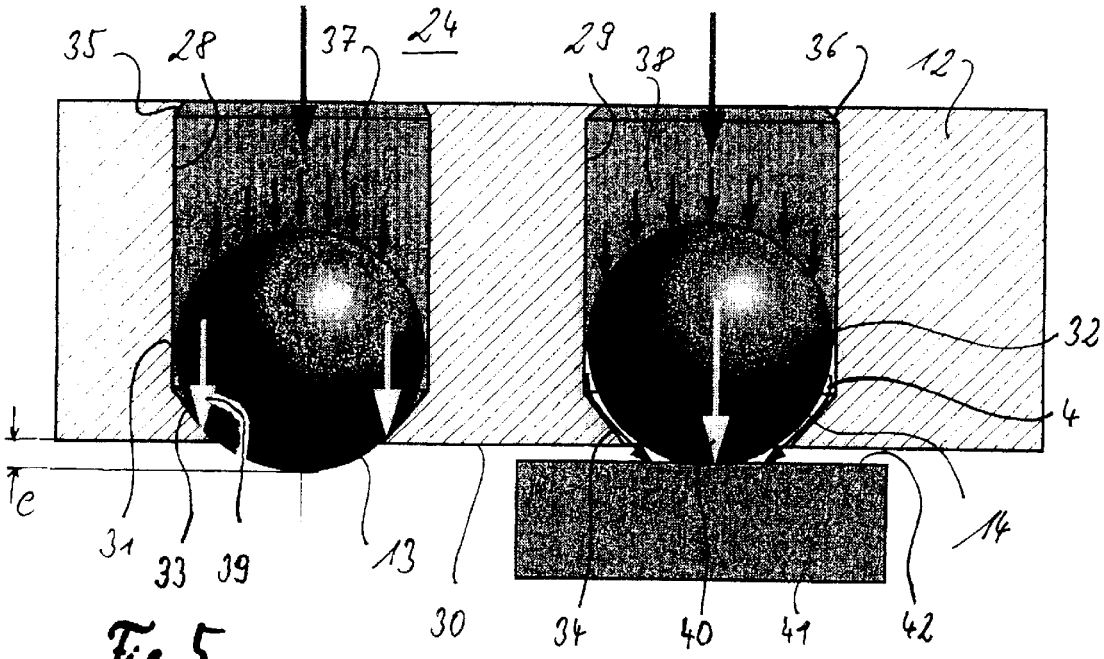
FIG. 5 is a schematic cutaway view, on an enlarged scale, of the tool, depicting an area to show the mode of operation of hydrostatic bearings.

According to the invention, the bearing arrangement of rolling elements 13, 14, shown in FIG. 5, is such that in the non-operative condition, in cooperation with the tool body 12, they assume a valve function. The rolling elements 13, 14 are held in boreholes 28, 29 of the tool body 12 such that they protrude beyond the external contour 30 of the tool body 12 by the dimension e. Rolling element 13 or 14 and borehole 28 or 29 are matched to each other such that a small circumferential sealing gap 31 or 32 results. The valve seat 33 or 34, which is a circumferential collar, prevents the rolling elements 13 or 14 from falling out of the tool body 12, while the circumferential collar 35 or 36 prevents the rolling elements 13 or 14 from falling into the inner chamber 24 of the tool 1.

The fluid pressure effective in the boreholes 28, 29, which fluid pressure is shown by arrows 37 or 38 in FIG. 5, generates a hydraulic force 39 or 40 which is directed towards the valve seat 33 or towards the workpiece 41. In this way the hydraulic force on the rolling element 13 ensures a tight seal of the borehole 28, thus preventing any loss of pressure fluid in the non-operative condition of the rolling element 13.

If due to the linear movement 26 of the tool 1, the rolling element 14 moves against the workpiece 41, then this rolling element 14 is lifted by the workpiece 41, while the hydraulic force which is still present in the borehole 29 presses the rolling element 14 against the workpiece surface 42. The force of the hydraulic fluid, indicated by arrow 40, generates considerable compressive strain in the workpiece surface 42 and causes plastification of the skin and the desired deformation of the same.

The sealing gap 31 or 32 is dimensioned such as to act as a hydraulic throttle and to only allow a small amount of fluid, indicated by arrow 43, to escape from the pressure chamber. In this way, the pressure for continuous generation of the rolling force is obtained in the pressure chamber, while at the same time the rolling element 14 can rotate in the borehole 29 practically without any friction. In this way the rolling element 14 can roll on the workpiece surface 42 until the end of the workpiece is reached and until the rolling element 14, due to the hydraulic force, can resume its non-operative position shown in the example of rolling element 13.

Figure 6:
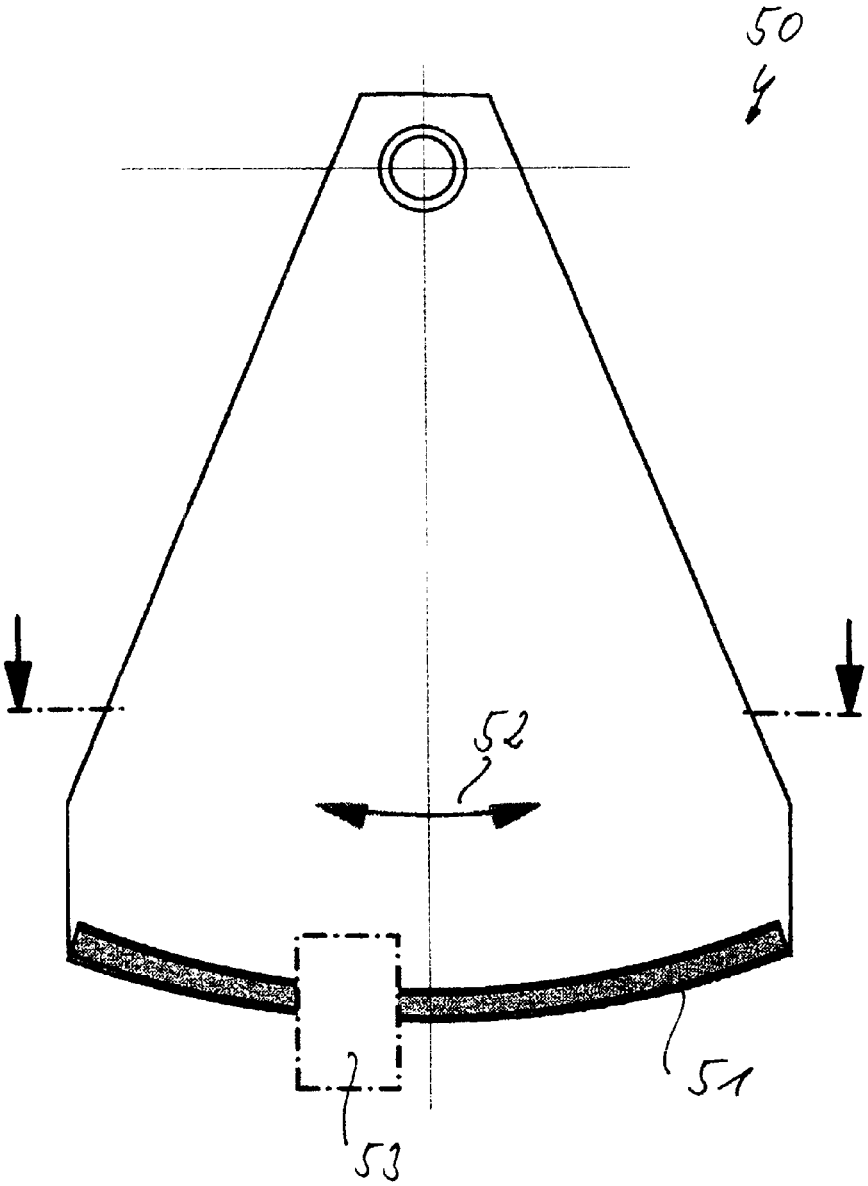
FIG. 6 is a schematic side view of a curved tool.
Figure 7:
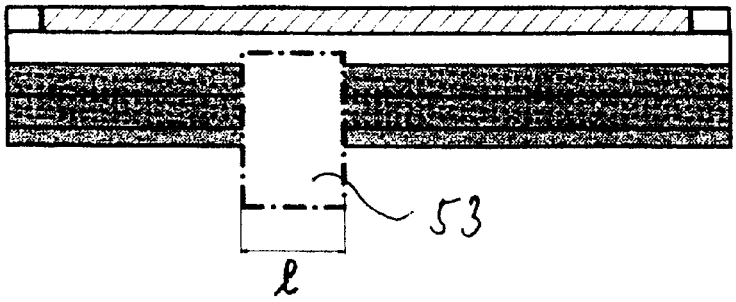
FIG. 7 is a top view of the curved tool shown in FIG. 6.

The tool 50 shown in FIGS. 6 and 7 is provided for workpieces with arc-shaped grooves. In this tool 50, the effective region 51 of the tool 50 is not straight but instead is shaped as an arc segment. The operation movement, as indicated by double arrow 52, is not linear but instead is a circular movement or a movement along a segment of a circle. In this way, curved surfaces on the workpiece 53 can be made along the length 1 of the workpiece 53.

Figure 8:
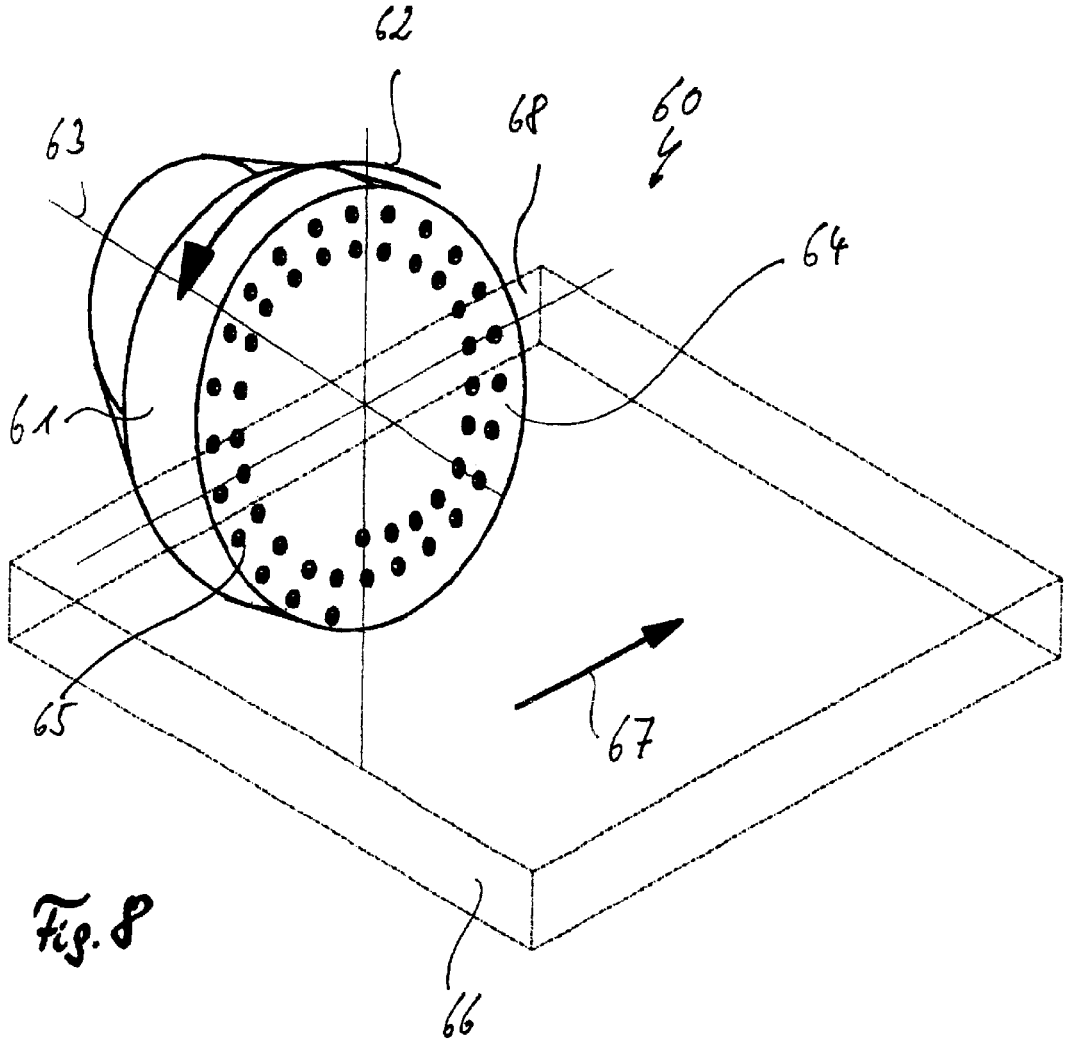
FIG. 8 is a schematic illustration of a tool with an essentially plain surface.

FIG. 8 shows a further embodiment of a rolling tool. In this rolling tool the tool body 61 is rotated on axis 63 in the direction indicated by the arrow 62. Thee tool body 61 has a plane surface 64 on which several rolling elements 65 are arranged in a spiral shape. A workpiece 66, shown by phantom line and transparent, is guided translationally along the tool in a direction of arrow 67 such that the lateral area 68 of the workpiece 66 is treated by means of the workpiece 60 and in particular by the rolling elements 65 in the manner of a polishing disc.

As a result of the translational movement of the workpiece and the rotary movement of the tool, the entire lateral area 68 of the workpiece 66 is rolled.

While the invention has been illustrated and described as embodied in a method of and tool for rolling a workpiece, and arrangement of a rolling tool and a workpiece, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents.

What is claimed is:

1. A method for rolling a workpiece comprising the steps of: applying a rolling tool to a workpiece, the tool provided with a plurality of rolling elements held in hydrostatic bearings, wherein during a rolling action, some of the rolling elements are in an engagement position with the workpiece occupying a sealing gap, while other rolling elements not engaging the workpiece are occupying a valve seat thereby sealing off the hydrostatic bearing by a gapless contact, and wherein in an operative condition the rolling elements occupying the sealing gap are engaging the workpiece whereby the valve seat opens and fluid flows through the sealing gap thereby reactivating the hydrostatic bearing and to effectively control flow of the hydrostatic medium of the bearing.

2. The method according to claim 1, wherein the rolling tool is moved in a linear or rotational manner.

3. The method according to claim 1, wherein with linear movement of the rolling tool in one direction, more than the same position of the workpiece is treated.

4. A bearing arrangement comprising a rolling tool body with rolling elements arranged in hydrostatic bearings for acting upon a work piece;

each of the hydrostatic bearing includes a borehole matched to the rolling element and to form a sealing gap;

a valve seat for holding the rolling element in the tool body; wherein in a non-operative condition, the rolling element assumes a position whereby the rolling element is held in the valve seat of the tool body and protrudes beyond the valve seat by a dimension for sealing off the hydrostatic bearing, and wherein in an operative condition the rolling element occupies the sealing gap thereby reducing the dimension and the rolling element is engaged with the workpiece whereby the valve seat is opened and fluid can run through the sealing gap for reactivating the hydrostatic bearing.

5. A rolling tool of claim 4, wherein the rolling elements are arranged so as to be distributed over an area.

6. The rolling tool according to claim 5, wherein the area is curved at least in one direction.

7. The rolling tool according to claim 5, wherein the area is kinked in at least one direction.

8. The rolling tool according to claim 5, wherein rolling elements which are arranged one behind the other in the direction of treatment, are arranged so as to be offset by a length b.

9. An arrangement of a rolling tool comprising several rolling elements arranged in hydrostatic bearings and a workpiece, each of the hydrostatic bearing provided with a sealing gap and a valve seat, wherein the rolling elements protrude beyond the hydrostatic bearing according to a distance between the hydrostatic bearing and the workpiece, and wherein the distance varies in dependence on the rolling elements acting upon the workpiece such that when distance is reduced the rolling element is in operative condition whereby the valve seat is opened and hydrostatic fluid can run through the sealing gap for reactivating the hydrostatic bearing.

10. A method for rolling a workpiece, comprising the steps of:

providing a rolling tool having a plurality of rolling elements supported by a plurality of hydrostatic bearings, whereby the hydrostatic bearings and the rolling elements are placed into one-to-one correspondence; and rolling a workpiece in a manner that at any time during a rolling operation a first number of the rolling elements of the rolling tool engage the workpiece to implement the rolling operation through a radial movement of the rolling element while a second number of non-engaging rolling elements of the rolling tool substantially seal the pertaining hydrostatic bearings of the rolling tool, and wherein in an operative condition the rolling element occupying the sealing gap is engaging the workpiece whereby the valve seat opens and fluid flows through the sealing gap thereby reactivating the hydrostatic bearing and to effectively control flow of the hydrostatic medium of the bearing.

11. The method of claim 10, wherein the rolling tool is moved during the rolling step in a linear or rotational manner.

12. The method of claim 10, wherein the rolling tool is moved during the rolling step in a linear direction to repeatedly roll the workpiece.

13. The rolling tool of claim 10, and further comprising a plurality of circumferential seals, each of the seals being disposed in the hydrostatic bearings in a region of the rolling elements, whereby the seals and the hydrostatic bearings are placed into one-to-one correspondence.

14. The rolling tool of claim 13, wherein the hydrostatic bearings have a sealing gap dimensioned to act as hydraulic throttle.

15. A rolling tool, comprising a tool body having a plurality of pockets to form hydrostatic bearings; and plural rolling elements supported by the hydrostatic bearings and provided in spaced-apart relationship to cover an area, wherein each of the hydrostatic bearings includes a borehole matched to the rolling element to form a sealing gap, and wherein in a non-operative condition, the rolling element assumes a sealing function, whereby the rolling element is held in a valve seat of the tool body and protrudes beyond the valve seat by a dimension, and wherein in an operative condition the rolling element aligns with the sealing gap.

16. The rolling tool of claim 15, wherein the area is curved at least in one direction.

17. The rolling tool of claim 15, wherein the area is kinked in at least one direction.

18. The rolling tool of claim 15, wherein the rolling elements are arranged on the tool body in rows, with sequential rolling elements in movement direction of the tool body disposed in offset relationship.

19. An arrangement, comprising a rolling tool having plural hydrostatic bearings for supporting a corresponding number of rolling elements; and a workpiece, wherein a first number of the rolling elements protrude beyond the hydrostatic bearings commensurate with a first distance between the hydrostatic bearings and the workpiece, while a second number of rolling elements protrude beyond the hydrostatic bearings by a second distance which is greater than the first distance, wherein the rolling elements that protrude beyond the hydrostatic bearing commensurate with a first distance occupy a sealing gap when in an operative condition whereby the valve seat is opened and fluid can run through the sealing gap for reactivating the hydrostatic bearing.

* * * * *